US005123831A

United States Patent [19]

Enqvist et al.

[11] Patent Number: 5,123,831

[45] Date of Patent: Jun. 23, 1992

[54] CONCRETE EXTRUSION MACHINE

[76] Inventors: Esa Enqvist, Tasanteenkatu 79, 33610 Tampere, Finland, 33400; Christopher P. Gregorig, 2023 Filuk Place, Abbotsford, B.C., Canada, V2S 5P2

[21] Appl. No.: 701,384

[22] Filed: May 16, 1991

[51] Int. Cl.[5] ..... B28B 1/00

[52] U.S. Cl. ..... 425/63; 264/70; 425/262; 425/426; 425/427

[58] Field of Search ..... 264/70, 209.1, 209.2, 264/211.23; 425/62, 63, 64, 65, 262, 380, 426, 427, 432, 456

[56] References Cited

U.S. PATENT DOCUMENTS

| | | | |
|---|---|---|---|
| 3,159,897 | 12/1964 | Ellis et al. | 425/64 |
| 3,284,867 | 11/1966 | Booth | 425/432 |
| 3,877,860 | 4/1975 | Putti | 425/64 |
| 4,022,556 | 5/1977 | Goetjen | 425/64 |
| 4,046,848 | 9/1977 | Putti | 425/64 |
| 4,292,014 | 9/1981 | Lupke et al. | 425/72 R |
| 4,330,242 | 5/1982 | Putti | 425/64 |
| 4,568,503 | 2/1986 | Laine et al. | 425/426 |
| 4,755,338 | 7/1988 | Harala | 425/64 |
| 4,786,242 | 11/1988 | Barsk | 425/63 |
| 4,842,788 | 6/1989 | Johnson | 264/68 |
| 5,023,030 | 6/1991 | Rantanen | 425/427 |

FOREIGN PATENT DOCUMENTS

| | | |
|---|---|---|
| 1193834 | 9/1985 | Canada . |
| 1205985 | 6/1986 | Canada . |
| 272860 | 8/1970 | U.S.S.R. . |

*Primary Examiner*—Jay H. Woo
*Assistant Examiner*—Scott Bushey
*Attorney, Agent, or Firm*—Townsend and Townsend

[57] ABSTRACT

An extrusion machine for making hollow elongated articles of concrete has an eccentric compaction disc that reciprocates and rotates to compact and release air from zero slump concrete. The machine avoids having to have a high frequency converter which is both expensive and noisy. At least one extruder screw is provided in the machine to feed concrete and form the elongated article. The screw has a die former at the outlet end to form a cavity in the elongated article. An eccentric compaction disc is positioned between the outlet end of the extruder screw and an input end of the die former, the input end of the die former is eccentric and coplanar with an eccentric disc face mounted for movement in a circular orbital path about the extruder screw axis. The output end of the die former is concentric with the extruder screw axis.

14 Claims, 7 Drawing Sheets

CONCRETE EXTRUSION MACHINE

BACKGROUND OF THE INVENTION

The present invention relates to an extrusion machine for making hollow elongated articles of concrete and more specifically to a concrete extruder apparatus that provides improved compacting of the concrete without undue noise.

The extruding of concrete by means of one or more extruder screws into an elongated article, sometimes referred to as a slab or plank, which has hollow cavities therein to provide the minimum amount of concrete to provide the required strength, is known. One example of such a forming machine is disclosed in U.S. Pat. No. 4,548,565. In this machine, concrete is forced through extruder screws onto a deck. The machine has wheels that ride on tracks on each side of the deck. As the concrete passes from the extruder screws, the machine moves along the tracks, the movement caused by the extruding concrete. A non-rotatable forming element or die former is provided to form the hollow cavities immediately following the downstream end of the extruder screws. Thus the concrete slab is formed and slowly hardens on the deck as the machine moves along the tracks. Side plates and a top plate are provided to control the external dimensions of the slab and the apparatus moves slowly so that the concrete does not collapse. In this way, concrete slabs of almost any length can be produced. These slabs are later cut by means of a diamond saw into required lengths.

After extrusion and before the concrete hardens, it is necessary to compact the concrete and remove any air trapped therein. This is generally achieved by vibration. The vibration helps to remove air in the wet concrete which rises to the top surface of the slab. It is known to provide a vibrator on the top plate of the forming machine. This top plate controls the depth of the slab after it has been extruded. A vibrator is also provided in or adjacent the die former to compact the concrete and release air from the hollows and voids in the concrete. In most of the existing concrete extrusion machines it has been found that high frequency vibration is required. In order to achieve this a frequency converter is positioned on the machine to provide high frequency for motors to rotate at high speeds to drive vibrators on the top plate and in the die former. In most cases the motors have rotation speeds in the order of 12,000 rpm. Whereas this arrangement works well, the converters produce an excessive noise causing an unpleasant environment for operators and others. Attempts to provide lower vibration frequencies on the top plate of the extrusion machine have been partially successful, but lower vibration frequencies on the vibrator in the die former has not provided satisfactory compacting of the concrete. The die former used in existing machines is a rigid steel unit, high frequencies are transmitted through the die former to the uncured, zero slump concrete, but low frequency does not provide sufficient vibration to fully compact the formed slab.

A vibration system presently available for die formers includes an eccentric weight on a shaft that rotates inside the die former at speeds as high as 12,000 rpm. The die former is made from steel and is rigid, thus high frequency vibrations are required in order to transmit the vibration through the die former to the concrete to provide compaction and air release.

SUMMARY OF THE INVENTION

It is an aim of the present invention to provide a concrete extrusion machine that compacts and releases air from zero slump concrete as the machine moves along on tracks with significantly reduced noise emissions. This will be achieved by eliminating the noisy and expensive frequency converter and high speed motors previously required. It is a further aim to provide a die former which is more flexible and has an eccentric entry end which follows a circular orbital path. Thus, a vibration or movement is provided by the die former itself rather than providing a separate vibrator within the die former.

The present invention provides in an extruder apparatus for making an elongated article of concrete, including at least one extruder screw and feed means to feed concrete to the extruder screw to form the elongated article and move the apparatus along a track, the extruder screw having a die former at an outlet end, adapted to form a cavity in the elongated article, and a finishing tube at an output end of the die former to provide smooth walls in the cavity, the improvement of means for compacting the elongated article while being formed, comprising: an eccentric compaction disc between the outlet end of the extruder screw and an input end of the die former, the disc having a concentric disc face adjacent the outlet end of the extruder screw concentric with an extruder screw axis, and an eccentric disc face eccentric with the extruder screw axis, the input end of the die former being eccentric and coplanar with the eccentric disc face, mounted for movement in a circular orbital path about the extruder screw axis, the output end of the die former being concentric with the extruder screw axis, and means to concurrently rotate the disc and cause the input end of the die former to move in the circular orbital path.

BRIEF DESCRIPTION OF DRAWINGS

In drawings which illustrate embodiments of the invention.

BEST MODES FOR CARRYING OUT THE INVENTION

Figure 1:
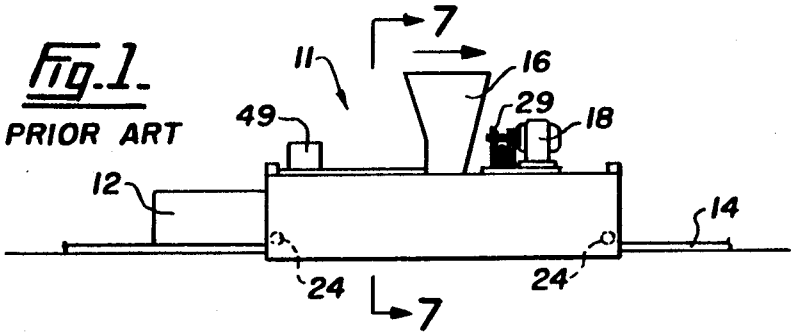
Fig. 1. PRIOR ART
FIG. 1 is a general view of a concrete extrusion machine known in the prior art.

FIG. 1 illustrates an extrusion machine 11 showing a hollow concrete slab 12 extruded from the machine onto a base and track 14. There is a hopper 16 through which the concrete is fed to the machine 11 and an electric motor 18 to drive the extruder screws. The machine 11 has wheels 24 to move the machine 11 on the track 14 in the direction of the arrow as the slab 12 is extruded. This is an existing type of machine known in the prior art.

Figure 2:
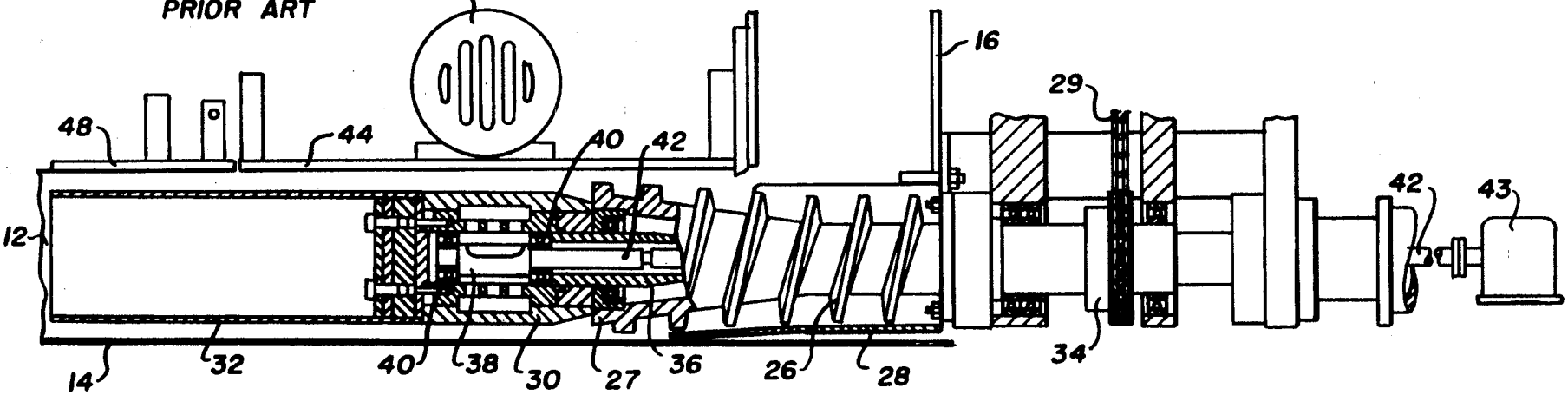
Fig. 2. PRIOR ART
FIG. 2 is a longitudinal sectional view through a concrete extrusion machine of the type shown in FIG. 1 having an eccentric weight rotatable in the die former to provide a vibration. This represents the prior art known today.

FIG. 2 illustrates the machine of FIG. 1 in somewhat more detail. The hopper 16 leads to an extruder screw 26 which has a trough 28 to guide the concrete as it is extruded. The extruder screw 26 compacts the concrete as it moves towards the outlet end 27. A die former 30 is connected to the outlet end 27 of the extruder screw 26, which in turn is connected to a finishing tube 32. The extruder screw 28 is driven by the motor 18 as shown in FIG. 1 through the chain drives 29 which rotate a chain sprocket 34. A stationary tubular shaft 36 extends through the extruder screw 26, on the extruder screw axis, and is connected to the die former 30 so that the die former 30 itself does not rotate. Furthermore, the finishing tube 32 is attached to the die former 30 therefore it too does not rotate. An eccentric weight 38 inside the die former 30 is mounted in bearings 40 and driven by shaft 42 from a high speed motor 43 rotating at a speed of approximately 12,000 rpm. The eccentric weight 38 causes the die former 30 to vibrate. The die former 30 itself is not flexibly mounted thus a high speed is required to provide a high frequency vibration to the die former 30.

The die former 30 has a slightly larger exterior cross-section than that of the finishing tube 32 to allow for some contraction as the machine advances and the concrete hardens. The speed of the machine 10 is variable but is dependent on the cross section of the slab 12 and the materials in the concrete mix. When several extruder screws are positioned side-by-side, it is necessary to control the feed of concrete through the hopper 16 to each screw. In some situations more concrete is needed in the end extruder screws to ensure the slab has a consistent thickness across the width.

Above the die former 30, and attached on each side of the machine 11 is a top plate 44 which has mounted thereon a vibrator motor 46. The vibrator motor rotates at 12,000 rpm and has a small eccentric weight therein to provide a similar vibration to the top plate 44 as is provided by the eccentric weight 38 rotating in the die former 30. The top plate 44 is vibrated to assist in compacting the concrete and to remove air from within the wet concrete. A troweling or finishing plate 48 is positioned downstream of the top plate 44. This finishing plate 48 smooths out the top of the concrete slab 12 as the machine moves along the track 14 leaving a smooth surface. An improved system for reciprocating the top plate 44 and a system for reciprocating side plates will be shown hereafter.

The extruding machine described and shown in FIGS. 1 and 2 is the type known in the prior art. In both cases the vibrating mechanisms are powered by motors that have to rotate at about 12,000 rpm and these motors operate on a high frequency produced by a frequency converter 49 positioned on one end of the machine 11 as shown in FIG. 1. All frequency converters are excessively noisy which, added to the vibratory noise from the forming dies 30 and vibrating plate 44, provides an unpleasant work environment.

Figure 3:
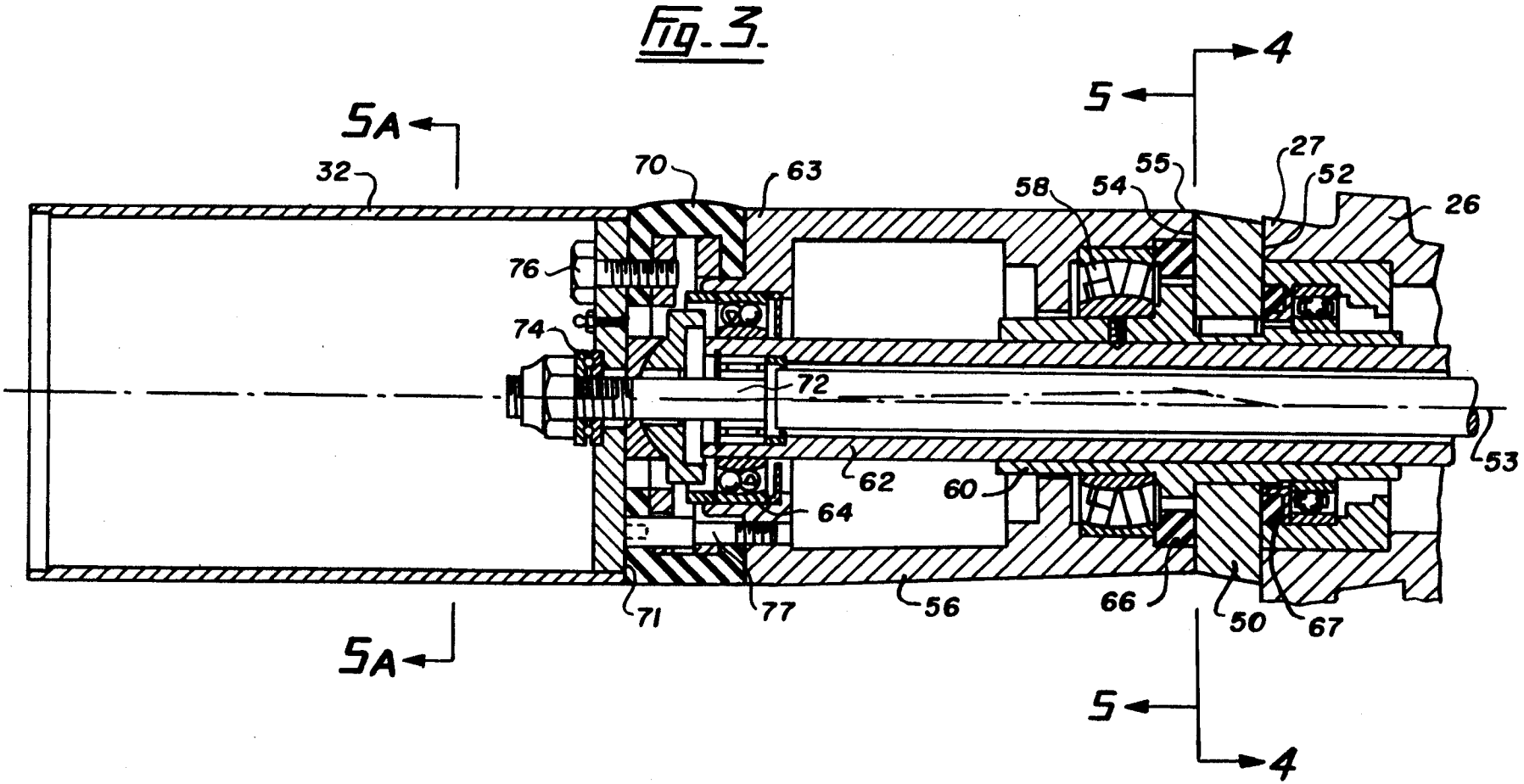
FIG. 3 is a longitudinal sectional view showing a detail of the die former, finishing tube, compaction disc and part of the conveyor screw representing one embodiment of the present invention.
Figure 5A:
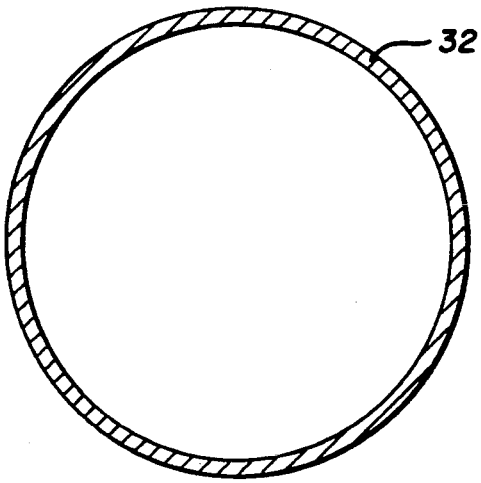
FIG. 5A is a cross-sectional view at line 5A—5A in FIG. 3 showing a circular finishing tube.
Figure 5B:
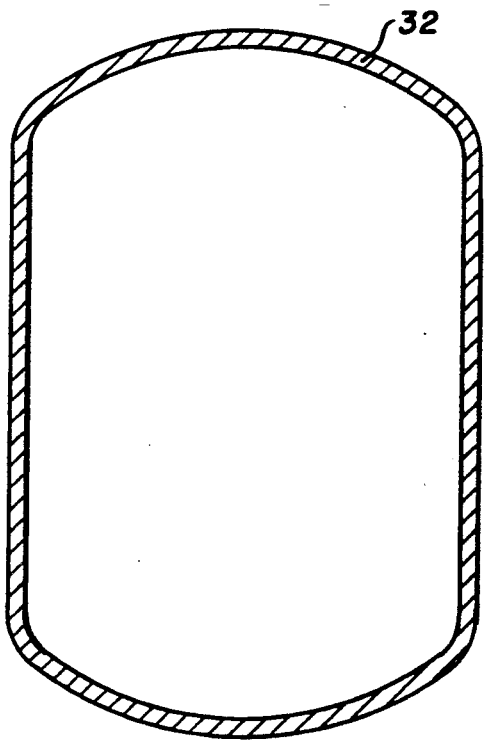
FIG. 5B is a cross-sectional view taken at line 5B—5B in FIG. 3A showing a non-circular finishing tube.
Figure 4:
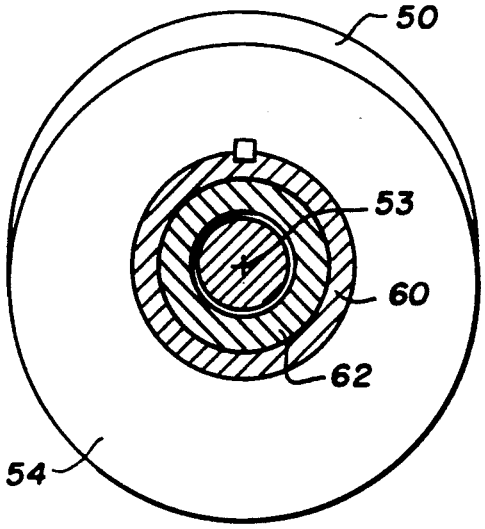
FIG. 4 is a cross-sectional view looking in the direction of the arrows 4—4 in FIG. 3.
Figure 5:
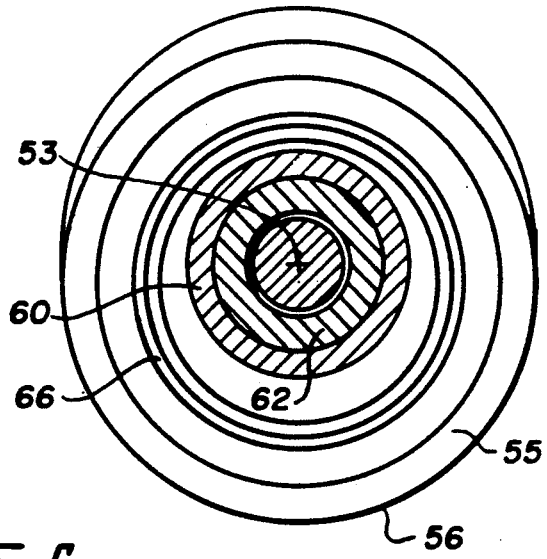
FIG. 5 is a cross-sectional view looking in the direction of the arrows 5—5 in FIG. 3.

FIGS. 3 to 5 illustrate an embodiment of the present invention with a different system for vibrating or eccentrically moving the die former 30. In this embodiment there is provided a compaction disc 50 mounted on the outlet end 27 of the extruder screw 26 and having a concentric disc face 52 adjacent the outlet end 27 of the extruder screw 26 concentric with the extruder screw axis 53. The diameter of this concentric disc face 52 is somewhat smaller than the diameter of the outlet end 27 of the extruder screw 26 to ensure there are no restrictions to prevent the flow of concrete off the extruder screw 26. The compaction disc 50 has an eccentric disc face 54 which is not parallel to the concentric disc face 52 but is coplanar with an input end 55 of the die former 56. The die former 56 at the input end 55 is mounted on a bearing 58 which in turn rotates on a bushing 60 which is eccentric to the conveyor screw axis 53. This eccentricity represents the same eccentricity as the compaction disc 50 between the concentric disc face 52 and the eccentric disc face 54, and therefore the eccentric disc face 54 is coplanar and has exactly the same diameter as the input end 55 of the die former 56.

The compaction disc 50 is keyed to a portion of the eccentric bushing 60 concentric with the conveyor screw axis 53 and is attached to a tubular drive shaft 62 that rotates at approximately 500 rpm. Thus, the drive shaft 62 is rotated through gears or chain and sprocket by a motor driven off standard frequencies and no frequency converter is required. When the shaft 62 rotates, the compaction disc 50 rotates with it and the eccentric bushing 60 also rotates which causes the input end 55 of the die former 56 to move in a circular orbital path about the extruder screw axis 53. The output end 63 of the die former 56 has another bearing 64 mounted on the end of the tubular drive shaft 62 concentric with the conveyor screw axis 53. Thus the die former 56 may remain stationary as the tubular drive shaft 62 rotates. A Teflon, registered trade mark for Polytetrafluroethylene, seal 66 is provided in the input end 55 of the die former 56 which rotates up against the eccentric disc face 54 of the compaction disc 50. A further Teflon seal 67 is provided in the output end 27 of the conveyor screw 26 which rotates up against the concentric disc face 52 of the compaction disc 50. These seals prevent liquid or concrete paste from entering the die former 56 or cavities in the conveyor screw 26.

FIG. 4 illustrates a section looking in the direction of arrows 4—4 in FIG. 3 on the eccentric disc face 54 showing that the eccentric disc face 54 is not concentric with the conveyor screw axis 53. FIG. 5 illustrates the same section looking in the direction of arrows 5—5 on the input end 55 of the die former 56, showing how the seal 66 and the periphery of the die former 56 are eccentric relative to the conveyor screw axis 53 yet concentric with the eccentric disc face 54 of the compaction disc 50.

A flexible seal 70 is provided between the output end 63 of the die former 56 and the attachment end 71 of the finishing tube 32. The flexible seal 70 permits the input end 55 of the die former 56 to move in the circular orbital path. The seal 70 compresses and flexes as the orbital movement moves the output end 63 of the die former 56 relative to the attachment end 71 of the finishing tube 32. As shown the finishing tube 32 is attached to a central shaft 72 by a thrust bearing 74, thus the finishing tube 32 is held in position but is free to rotate. The finishing tube 32 is joined at the attachment end 71 to the flexible seal 70 by bolts 76. Long bolts 77 join the flexible seal 70 to the output end 63 of the die former 56, thus the finishing tube 32 and the die former 56 cannot rotate relative to each other, but can rotate together.

Figure 3A:
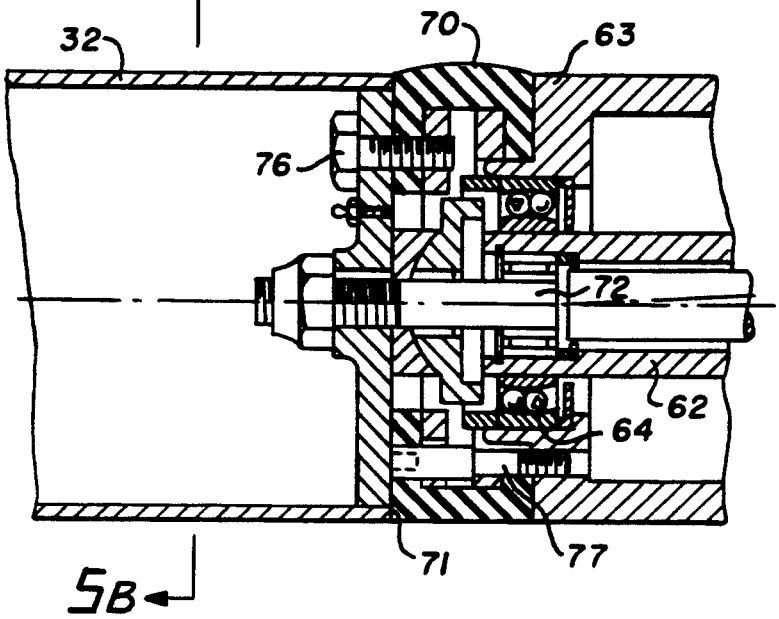
FIG. 3A is a longitudinal detail sectional view similar to that shown in FIG. 3, wherein the die former and finishing tube do not rotate.
Figure 3B:
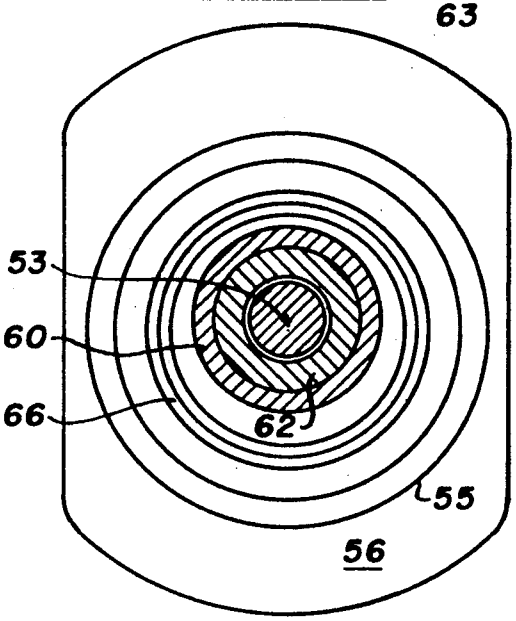
FIG. 3B is a cross-sectional view taken at an input end of a die former looking downstream towards the output end, showing a non-circular output end on the die former.

The embodiment shown illustrates a die former 56 and finishing tube 32 which have a circular cross-section, as shown in FIGS. 5 and 5A, and on this basis the die former 56 and finishing tube 32 are free to rotate but are not driven. If, however, the cavity or hollow in the concrete slab is not circular but is oval, or another non-circular shape, then the thrust bearing 74 is omitted and the finishing tube 32 is keyed to the fixed shaft 72, as shown in FIGS. 3A, 3B and 5B, so that neither the finishing tube 32 nor the die former 56 can rotate. The die former 56 to produce a non-circular cavity starts with a circular input end 55 and slowly changes shape along the length to the required shape at the output end 63. This is seen in FIG. 3B which is a cross-sectional view looking downstream from the input end 55 of the die former 56 similar to FIG. 5 which shows a die former 56 to produce a circular cavity. The cross-sectional shape of the finishing tube 32, as shown in FIGS. 5A and 5B, is preferably slightly smaller than that of the output end 63 of the die former 56 to allow for relaxation of the concrete as it hardens.

Figure 7:
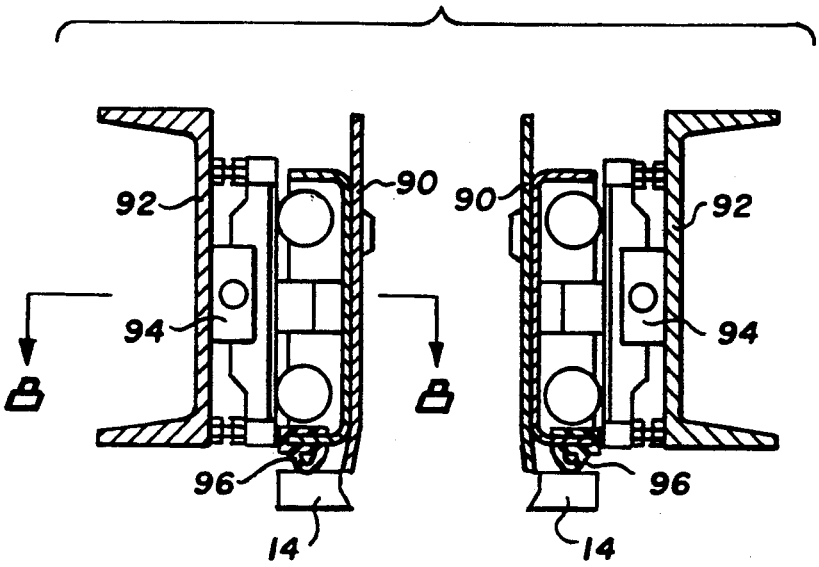
FIG. 7 is a sectional view taken at 7—7 of FIG. 1 showing side plate vibrators according to an embodiment of the invention.
Figure 8:
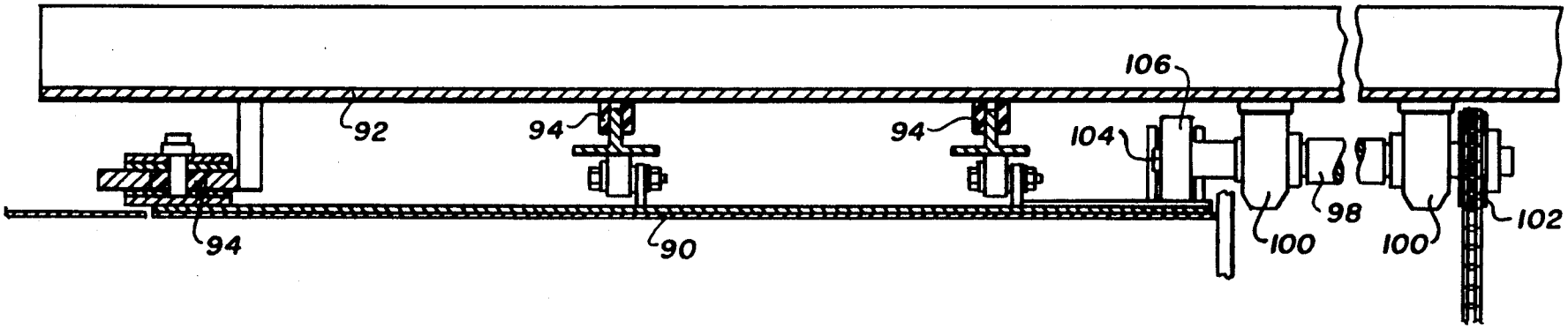
FIG. 8 is a sectional view taken at line 8—8 of FIG. 7

As well as compacting the concrete with the eccentric rotation of the die former 56, in another embodiment, compacting side plates 90 are provided as shown in FIGS. 7 and 8. Side members 92 of the extrusion machine 11 support the compacting side plates 90 with flexible mountings 94, and rubber seals 96, at the bottom of the side plates 90 rest on the tracks 14 to prevent concrete paste leaking as the extrusion machine 11 advances.

As shown in FIG. 8, a drive shaft 98 is supported by two pillow block bearings 100 mounted on the side member 92, and is driven by a chain and sprocket 102. A motor which, is preferably a 3600 rpm motor (not shown), so that it can operate on a standard frequency rotates the shaft, and the drive shaft 98 has an eccentric end 104 which rotates in another pillow block bearing 106 mounted on the inside of the compacting side plate 90. Thus an eccentric movement from the eccentric shaft end 104 is transferred to the compacting side plates 90 which has a compacting effect upon the sides of the concrete slab 12 as the machine 11 advances.

Figure 9:
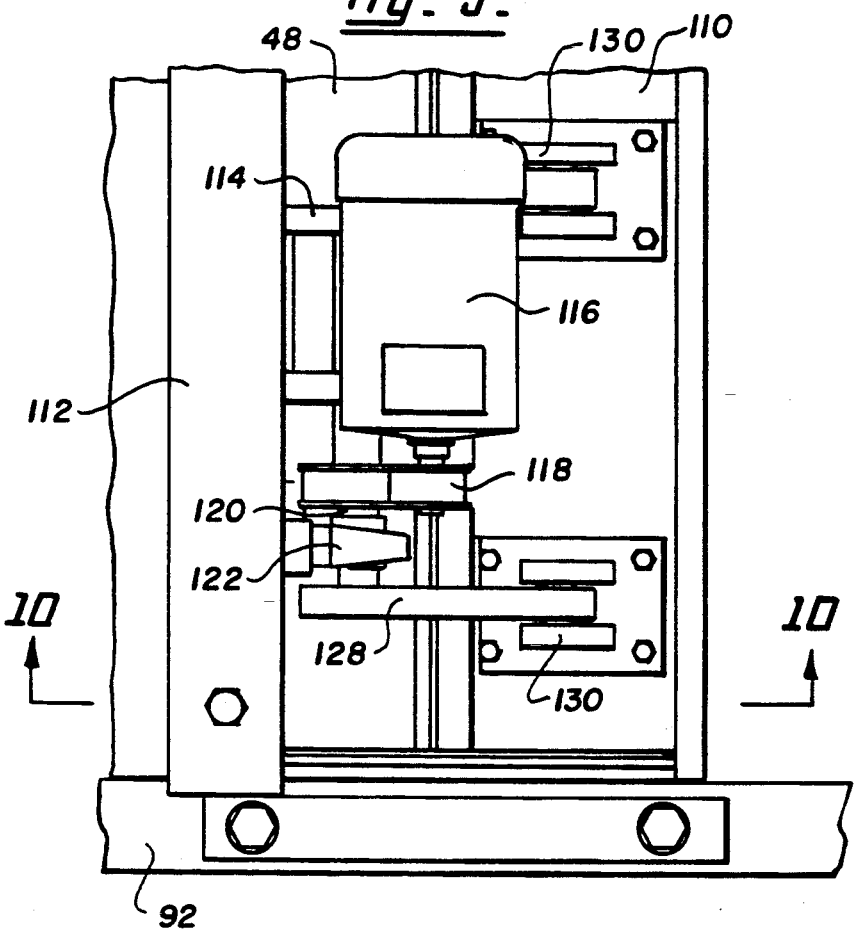
FIG. 9 is a top plan view of a top plate with a motor mounted on a frame and an eccentric drive to reciprocate the top plate.
Figure 10:
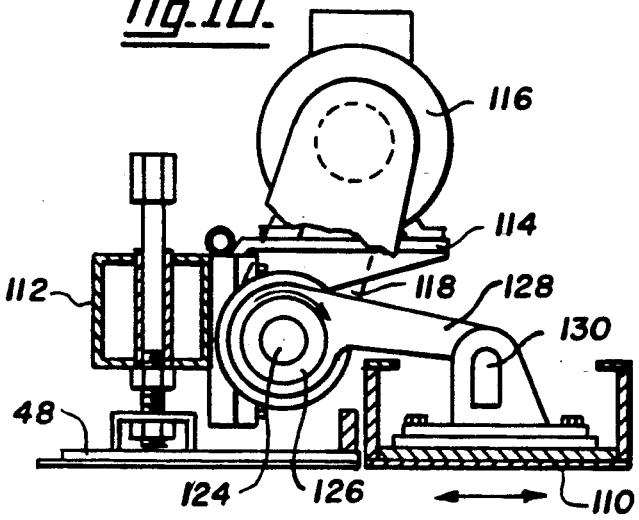
FIG. 10 is a sectional view taken at line 10—10 of FIG. 9.

FIGS. 9 and 10 illustrate a compacting top plate 110 replacing the vibratory top plate 44 shown in FIG. 2. A cross support member 112 extends across the two side members 92 and has a bracket 114 attached thereto having a motor 116 which drives belt drive 118 to a drive shaft 120. This is supported on pillow block bearings 122 from the cross support member 112. The drive shaft 120 has eccentric end bushings 124 which rotate in bearings 126 attached to a reciprocating arm 128 attached to the compacting top plate 110 by rubber bushings and washers 130. The motor 116 rotates at 3600 rpm in one embodiment and provides a reciprocal movement through the eccentric bushing 124 and the rubber bushings 130 to the compacting top plate 110. The compacting effect is adequate for compacting the concrete and releasing air. A finishing plate 48 is shown supported from the cross support member 112 and performs the same function as shown in FIG. 2.

Figure 6A:
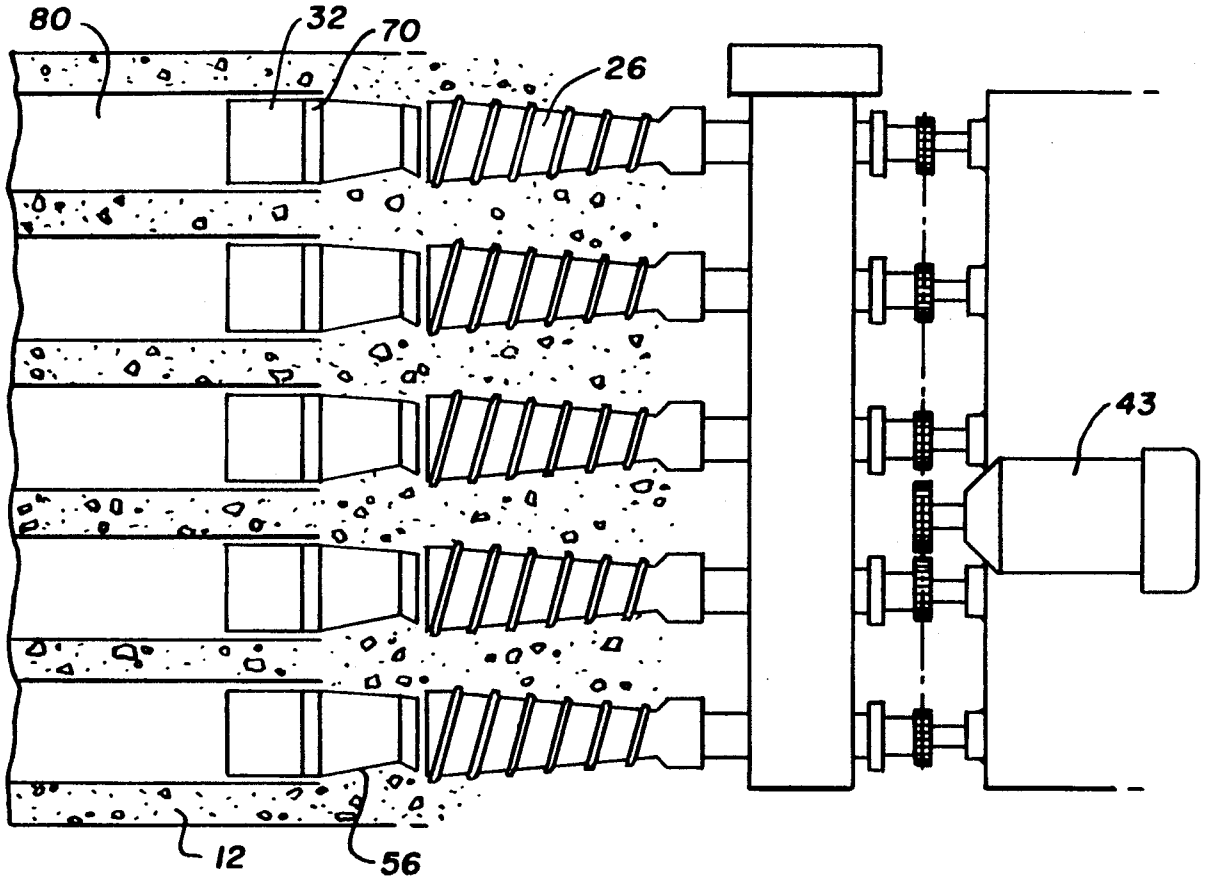
FIG. 6A is a plan view of a concrete extrusion machine according to one embodiment of the present invention for extruding the concrete slab shown in FIG. 6.
Figure 6:
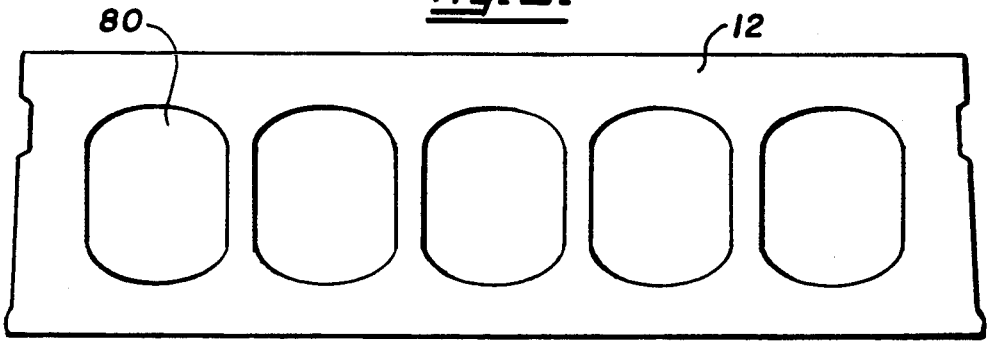
FIG. 6 is a sectional view showing a typical hollow core slab of concrete as formed on the concrete extrusion machine of the present invention.

FIG. 6 illustrates a concrete extruded slab 12 resting on a base 14 having cavities 80 therein. After the machine 10 as shown in FIG. 1 and FIG. 6A has extruded the slab 12, and the concrete has hardened, it is cut by a diamond saw into the required lengths.

The extruder screw 26 generally rotates at about 50 rpm, whereas the compaction disc 50 is required to rotate at about 500 rpm. It has been found that a vibratory motor 46 mounted on a top plate 44 as shown in FIG. 2 may rotate at approximately 3600 rpm. An eccentric weight rotating at this speed provides sufficient vibration to assist in compacting the concrete and releasing air as the concrete slab is formed. The top plate 44 is supported on mounts (not shown) that are sufficiently flexible so the rotor 46 vibrates the plate 44.

Various changes may be made to the embodiments shown herein without departing from the scope of the present invention which is limited only by the following claims.

The embodiments of the present invention in which an exclusive property or privilege is claimed are defined as follows:

1. In an extruder apparatus for making an elongated article of concrete, including at least one extruder screw and feed means to feed concrete to the extruder screw to form the elongated article and move the apparatus along a trace, the extruder screw having a die former at an outlet end to form a cavity in the elongated article, and a finishing tube at an output end of the die former to provide smooth walls in the cavity, the improvement of means for compacting the elongated article while being formed, comprising:

an eccentric compaction disc between the outlet end of the extruder screw and an input end of the die former, the disc having a concentric disc face adjacent the outlet end of the extruder screw concentric with an extruder screw axis, and an eccentric disc face eccentric with the extruder screw axis;

the input end of the die former being eccentric and coplanar with the eccentric disc face, mounted for movement in a circular orbital path about the extruder screw axis;

the output end of the die former being concentric with the extruder screw axis, and means to concurrently rotate the disc and cause the input end of the die former to move in the circular orbital path.

2. The extruder apparatus according to claim 1 wherein a plurality of extruder screws are provided to form a plurality of cavities in line in the elongated article.

3. The extruder apparatus as claimed in claim 1 wherein the output end of the die former and the finishing tube are circular, and wherein the die former and the finishing tube are together free to rotate.

4. The extruder apparatus according to claim 1 wherein the output end of the die former is not circular, and the die former and the finishing tube are not free to rotate.

5. The extruder apparatus according to claim 4 wherein the finishing tube is attached to a fixed shaft extending from within the extruder screw on the extruder screw axis.

6. The extruder apparatus according to claim 4 wherein the die former has a circular input end, a cross-section that changes gradually from the input end to the output end and wherein the finishing tube has the same cross-sectional shape as the output end of the die former.

7. The extruder apparatus according to claim 1 including a flexible seal between the die former and the finishing tube.

8. The extruder apparatus according to claim 1 wherein the means to rotate the disc and cause the input end of the die former to move in the circular orbital path, comprises a tubular shaft keyed to the disc.

9. The extruder apparatus according to claim 8 wherein the finishing tube is supported on a fixed shaft extending from within the extruder screw, and wherein the die former is supported on bearings mounted on an eccentric bushing attached to the tubular shaft.

10. The extruder apparatus according to claim 1 wherein the finishing tube has means to prevent rotation relative to the die former.

11. The extrusion apparatus according to claim 1 wherein the die former output end has a larger cross-section than the finishing tube.

12. The extruder apparatus according to claim 1 wherein the finishing tube has a consistent cross-section throughout its length.

13. The extruder apparatus according to claim 1 including a seal between the eccentric disc face of the disc and the input end of the die former.

14. The extruder apparatus according to claim 1 wherein the means to concurrently rotate the disc and cause the input end of the die former to move in the circular orbital path, rotates at approximately 500 rpm.

* * * * *